United States Patent [19]

Kanda et al.

[11] Patent Number: 4,803,193

[45] Date of Patent: Feb. 7, 1989

[54] HEAT-SENSITIVE RECORDING MATERIAL USING CHROMENO COMPOUND

[75] Inventors: Nobuo Kanda, Hirakata; Yukihiro Abe, Nishinomiya; Mitsuru Kondo, Hyogo, all of Japan

[73] Assignee: Kanzaki Paper Manufacturing Co., Ltd., Tokyo, Japan

[21] Appl. No.: 137,368

[22] Filed: Dec. 23, 1987

[30] Foreign Application Priority Data

Dec. 27, 1986 [JP] Japan ..... 61-314744

[51] Int. Cl.[4] ..... B41M 5/18

[52] U.S. Cl. ..... 503/209; 427/151; 428/913; 503/210; 503/211; 503/212; 503/217; 503/218; 503/223

[58] Field of Search ..... 427/150–152; 428/195, 913, 914; 503/208–212, 217, 218, 220, 223

[56] References Cited

U.S. PATENT DOCUMENTS 4,174,856 11/1979 Balli et al. ..... 503/217
4,220,356 9/1980 Usui et al. ..... 427/151
4,506,073 3/1985 Balli et al. ..... 546/64

FOREIGN PATENT DOCUMENTS 0124377 11/1984 European Pat. Off. ..... 503/220

*Primary Examiner*—Bruce H. Hess
*Attorney, Agent, or Firm*—Armstrong, Nikaido, Marmelstein & Kubovcik

[57] ABSTRACT

In a heat-sensitive recording material comprising on a substrate a recording layer containing a colorless or pale-colored basic dye and an electron accepting reactant material, the heat-sensitive recording material which is characterized in that the basic dye comprises at least one chromeno compound represented by the formula [I] below

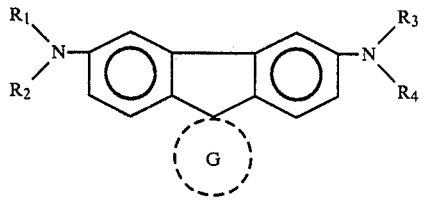

(I)

wherein G and $R_1 \sim R_4$ are defined in the specification.

10 Claims, No Drawings

HEAT-SENSITIVE RECORDING MATERIAL USING CHROMENO COMPOUND

The present invention relates to a heat-sensitive recording material using a chromeno compound, the chromeno compound capable of forming an image which is excellent in light resistance and readable by optical character-reading devices.

Various methods are proposed which are adapted to record informations by contacting with use of pressure, heat, electricity, light or like energy a colorless or pale-colored basic dye with an organic or inorganic electron accepting reactant material for a color forming reaction. For example, as described on pages 411 to 421, 463 to 470, vol. 30, 1976 of JAPAN TAPPI by Kondo and Iwasaki, many methods are proposed such as pressure-sensitive manifold sheet, heat-sensitive recording sheet, electrothermal recording sheet, ultrasonic recording sheet, electron ray recording sheet, electrostatic recording sheet, photosensitive recording sheet, photosensitive print material, type ribbon, ball-point pen ink, crayon, stamp ink, etc.

In the above recording materials, crystal violet lactone is most generally used as a colorless or pale-colored basic dye which forms blue images. Although this dye forms clear blue-purple images immediately upon contact with an electron accepting reactant material, the image is extremely poor in resistance to sunlight and has a defect of disappearing in a short period of time by ultraviolet rays. With a trend toward more efficient office work in recent years, optical character-reading devices are in greatly increasing use for reading the record images on record media. However, the images obtained from the above dye have no light absorbency in an infrared region of 700 to 900 nm and can not be read by optical character-reading devices.

As a basic dye readable by the optical device, a phthalide derivative is proposed in EP No. 124,377 A. The phthalide derivative is contacted with an electron accepting reactant material to form an image which colors in blue-green or green, has light absorbency in an infrared region of 700 to 900 nm and can be read by optical character-reading devices.

However, since the heat-sensitive recording material using the phthalide derivative fades in color influenced by humidity, heat and like external conditions, the differences in light absorption in the near infrared region become small between the record images and the background (non-image area). Consequently, it is difficult to read the images by optical character-reading devices. Further, the recording layer has a defect of turning into yellow-color with a lapse of time.

An objects of the present invention is to provide a heat-sensitive recording material which is free from the above defects and can form an image readable by optical character-reading devices by use of a chromeno compound.

The above and other objects of the invention will become apparent from the following description.

The present invention provides a heat-sensitive recording material comprising at least one chromeno compound as a colorless or pale-colored basic dye,

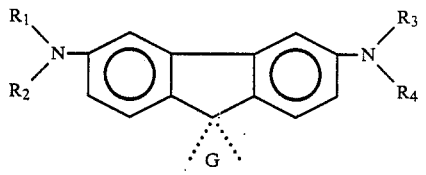

[I]

wherein G represents the following:

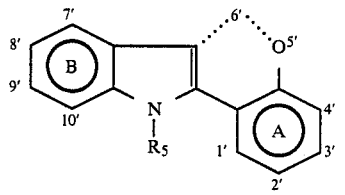

(a)

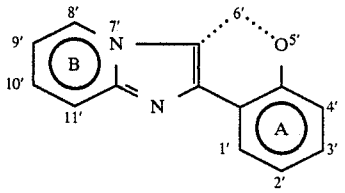

(b)

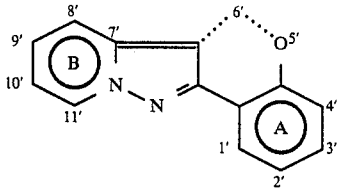

(c)

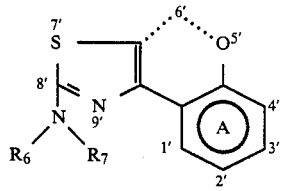

(d)

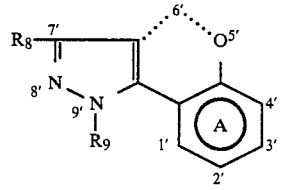

(e)

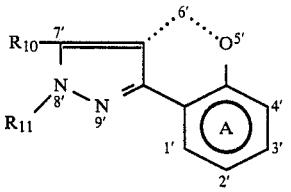

(f)

$R_1$, $R_2$, $R_3$ and $R_4$ are each hydrogen atom; $C_{1\sim12}$ alkyl unsubstituted or substituted with halogen atom or $C_{1\sim4}$ alkoxyl; $C_{3\sim12}$ alkenyl unsubstituted or substituted with phenyl; $C_{3\sim12}$ alkynyl unsubstituted or substituted with phenyl; $C_{5\sim12}$ cycloalkyl unsubstituted or substituted with $C_{1\sim4}$ alkyl; phenyl-$C_{1\sim2}$ alkyl unsubstituted or substituted with halogen atom, nitro, $C_{1\sim4}$ alkyl or $C_{1\sim4}$ alkoxyl; phenyl unsubstituted or substituted with halogen atom, nitro, $C_{1\sim4}$ alkyl, $C_{1\sim4}$ alkoxyl or $C_{1\sim4}$ halogenated alkyl; naphthyl unsubstituted or substituted with halogen atom, nitro, $C_{1\sim4}$ alkyl, $C_{1\sim4}$ alkoxyl or $C_{1\sim4}$ halogenated alkyl; $R_1$ and $R_2$, and $R_3$ and $R_4$ may form together therewith or with an adjacent benzene ring a heteroring selected from the group consisting of pyrrolidine ring, piperidine ring, morpholine ring, hexamethyleneimine ring, tetrahydroquinoline ring and julolidine ring; $R_5$, $R_6$, $R_7$, $R_8$, $R_9$, $R_{10}$ and $R_{11}$ are each hydrogen atom; $C_{1\sim12}$ alkyl unsubstituted or substituted with halogen atom or $C_{1\sim4}$ alkoxyl; $C_{3\sim12}$ alkenyl unsubstituted or substituted with phenyl; $C_{3\sim12}$ alkynyl unsubstituted or substituted with phenyl; benzyl unsubstituted or substituted with halogen atom, nitro, $C_{1\sim4}$ alkyl or $C_{1\sim4}$ alkoxy; phenyl unsubstituted or substituted with halogen atom, nitro, $C_{1\sim4}$ alkyl, $C_{1\sim4}$ alkoxyl or $C_{1\sim4}$ halogenated alkyl; naphthyl unsubstituted or substituted with halogen atom, nitro, $C_{1\sim4}$ alkyl, $C_{1\sim4}$ alkoxy or $C_{1\sim4}$ halogenated alkyl; $R_6$ and $R_7$ may form a pyrrolidine ring together therewith, each of the benzene ring A and benzene ring B may be substituted by halogen atom; $C_{1\sim4}$ alkyl; $C_{1\sim4}$ alkoxyl; benzyl unsubstituted or substituted with halogen atom, nitro, $C_{1\sim4}$ alkyl or $C_{1\sim4}$ alkoxyl; phenyl unsubstituted or substituted with halogen atom, nitro, $C_{1\sim4}$ alkyl or $C_{1\sim4}$ alkoxyl; amino unsubstituted or substituted with $C_{1\sim4}$ alkyl.

The chromeno compound used in the present invention and represented by the above formula [I] is a colorless or pale-colored compound and is contacted with an electron accepting reactant material to form a clear bluish image having a high color density. The heat-sensitive recording material using this compound as a color forming material produces an image which does not fade even when allowed to place at high temperature and high humidity conditions or when exposed to sunlight for a long period of time. The image has excellent characteristics of maintaining an initial color and light absorbency in an infrared region of 700 to 900 nm.

Among the above chromeno compounds of the formula [I], preferable is a compound of the formula [I'] below which can be easily synthesized and is economical.

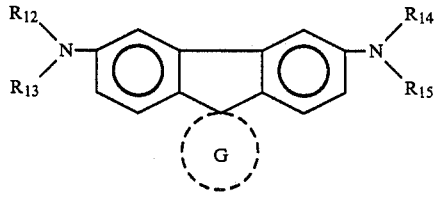

[I']

wherein G represents the following:

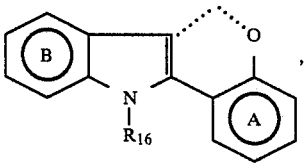

-continued

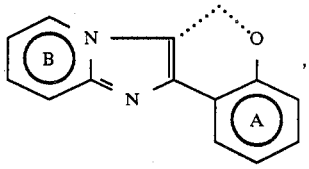

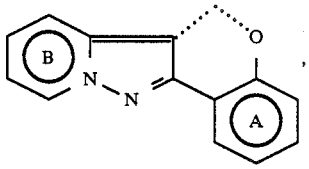

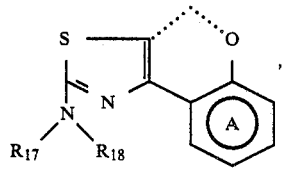

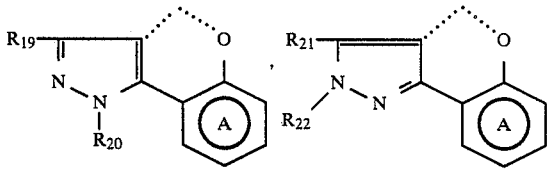

$R_{12}$, $R_{13}$, $R_{14}$ and $R_{15}$ are each hydrogen atom; $C_{1\sim5}$ alkyl unsubstituted or substituted with $C_{1\sim2}$ alkoxyl; allyl; $C_{5\sim6}$ cycloalkyl; phenyl-$C_{1\sim2}$ alkyl unsubstituted or substituted with halogen atom, $C_{1\sim2}$ alkyl or $C_{1\sim2}$ alkoxy; phenyl unsubstituted or substituted with halogen atom, $C_{1\sim2}$ alkyl or $C_{1\sim2}$ alkoxyl; $R_{12}$ and $R_{13}$, and $R_{14}$ and $R_{15}$ may form together therewith a heteroring selected from the group consisting of pyrrolidine ring, piperidine ring, morpholine ring and hexamethyleneimine ring; $R_{16}$, $R_{17}$, $R_{18}$, $R_{19}$, $R_{20}$, $R_{21}$ and $R_{22}$ are each hydrogen atom; $C_{1\sim4}$ alkyl; benzyl; phenyl unsubstituted or substituted with $C_{1\sim2}$ alkyl or $C_{1\sim2}$ alkoxyl; $R_{17}$ and $R_{18}$ may form a pyrrolidine ring together therewith, each of the benzene ring A and benzene ring B may be substituted by halogen atom; $C_{1\sim4}$ alkyl; $C_{1\sim4}$ alkoxyl; benzyl; phenyl; amino unsubstituted or substituted with $C_{1\sim4}$ alkyl.

The chromeno compound used in the present invention which has the above excellent characteristics and represented by the formula [I] can be prepared, for example, by the following typical three kinds of methods.

1. A method of reacting 3,6-diaminofluorenone derivative of the formula [II]

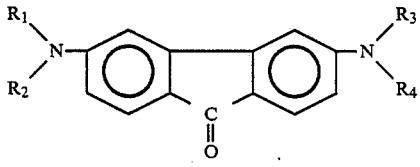

[II]

with a phenol derivative of the formulae [III] to [VIII]

[III]

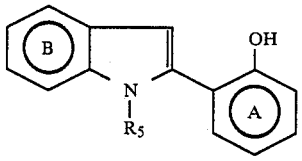

[IV]

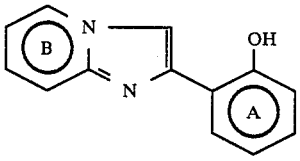

[V]

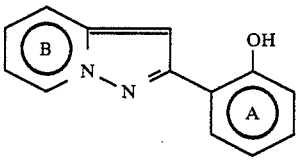

[VI]

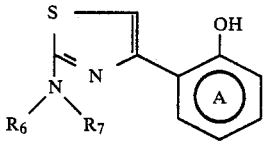

[VII]

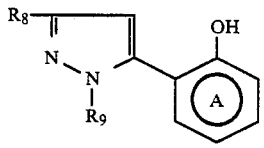

[VIII]

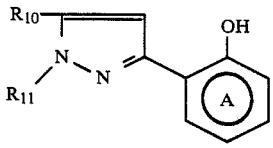

wherein $R_1$ to $R_{11}$, benzene rings A and B are the same as above.

The reaction is conducted with stirring in an appropriate solvent with use of a dehydration catalyst, when required, with heating. Examples of useful solvents are methanol, ethanol, chloroform, benzene, toluene, dioxane, tetrahydrofuran, dimethylsulfoxide, etc. The catalysts include hydrochloric acid, sulfuric acid, phosphorus oxychloride, phosphorus pentoxide, thionyl chloride, zinc chloride, aluminum chloride, tin chloride, etc.

2. A method of diazotizing chromeno compound of the formula [IX]

[IX]

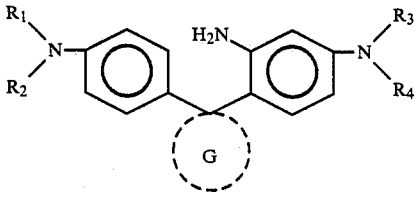

in sulfuric acid and ring-closing the resulting diazo compound in the presence of copper powder or copper compound for several hours. In the above, G, $R_1$ to $R_4$ are the same as above.

3. A method of heating chromeno compound of the formula [X]

[X]

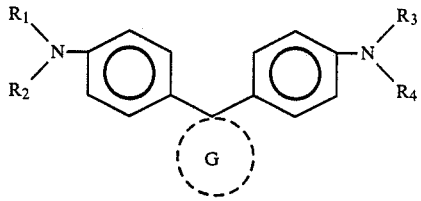

in a mixture of aluminum chloride and urea for several hours. In the above, G, $R_1$ to $R_4$ are the same as above.

The chromeno compound used in the present invention and represented by the above formula [I] is a colorless or pale-colored basic dye having the above excellent properties and exhibits excellent effects when used as a color former which is reacted with an electron accepting reactant material (hereinafter referred to as "color acceptor") to form a record image in a heat-sensitive recording material.

The above heat-sensitive recording material contains at least one chromeno compound used in the present invention, but the following various kinds of basic dyes can be conjointly used as required in a desired proportion.

Triarylmethane lactones, e.g., 3,3-bis(p-dimethylaminophenyl)-6-dimethylaminophthalide, 3-(p-dibenzylaminophenyl)-3-(1,2-dimethylindole-3-yl)-7-azaphthalide, 3-(4-diethylamino-2-ethoxyphenyl)-3-(1-ethyl-2-methylindole-3-yl)-7-azaphthalide, 3,3-bis(1-ethyl-2-methylindole-3-yl)phthalide, etc.

Fluorans, e.g., 3-diethylamino-6-methylfluoran, 3-diethylamino-6-methyl-7-chlorofluoran, 3-(N-ethyl-N-p-tolylamino)-7-methylfluoran, 3-diethylamino-6-methyl-7-anilinofluoran, 3-(N-ethyl-N-isopentylamino)-6-methyl-7-anilinofluoran, 3-(N-ethyl-N-tetrahydrofurfurylamino)-6-methyl-7-anilinofluoran, 3-(N-cyclohexyl-N-methylamino)-6-methyl-7-anilinofluoran, 3-(N-cyclopentyl-N-ethylamino)-6-methyl-7-anilinofluoran, 3-(N-ethyl-N-p-tolylamino)-6-methyl-7-anilinofluoran, 3-diethylamino-6-chloro-7-anilinofluoran, 3-dibutylamino-7-o-chloroanilinofluoran, 3-butylamino-7-o-fluoroanilinofluoran, etc.

Spiropyrans, e.g., di-$\beta$-naphthospiropyran, 3-methyl-di-$\beta$-naphthospiropyran, etc.

Diphenylmethanes, e.g. 4,4'-bis-dimethylaminobenzhydryl benzyl ether, 4,4'-bis-dimethylaminobenzhydryl-p-toluenesulfinate, etc.

Azines, e.g., 3,7-bis(dimethylamino)-10-benzoylphenothiazine, 3,7-bis(diethylamino)-10-benzoylphenoxazine, etc.

Triarylmethanes, e.g., N-butyl-3-[bis{4-(N-methylanilino)phenyl}methyl]carbazole, etc.

In the present heat-sensitive recording material, substances which function as Br$\phi$nsted acid or Lewis acid are preferably used as a color acceptor in combination with the above chromeno compound. Examples thereof are inorganic color acceptors such as acid clay, activated clay, attapulgite, bentonite, colloidal silica, aluminum silicate, magnesium silicate, zinc silicate, tin silicate, calcined kaolin, talc, etc.; organic color acceptors such as oxalic acid, maleic acid, tartaric acid, citric acid, succinic acid, stearic acid and like aliphatic carboxylic acids, benzoic acid derivative, phthalic acid derivative, gallic acid derivative, salicylic acid derivative, naphthoic acid derivative, iodole-2-carboxylic acid derivative and like aromatic carboxylic acids, 4,4'-isopropylidenediphenol, 4,4'-isopropylidenebis(2-chlorophenol), 4,4'-isopropylidenebis(2,6-dichlorophenol), 4,4'-isopropylidenebis(2,6-dibromophenol), 4,4'-isopropylidenebis(2-methylphenol), 4,4'-isopropylidenebis(2,6-dimethylphenol), 4,4'-isopropylidenebis(2-tert-butylphenol), 4,4'-sec-butylidenediphenol, 4,4'-sec-pentylidenediphenol, 4,4'-cyclohexylidenebisphenol, 4,4'-cyclohexylidenebis(2-methylphenol), 4-tert-butylphenol, 4-phenylphenol, 4-hydroxydiphenoxide, α-naphthol, β-naphthol, methyl 4-hydroxybenzoate, benzyl 4-hydroxybenzoate, 2,2'-thiobis(4,6-dichlorophenol), 4-tert-octylcatechol, 2,2'-methylenebis(4-chlorophenol), 2,2'-methylenebis(4-methyl-6-tert-butylphenol), bis[2-(4-hydroxyphenylthio)ethyl]ether, 4,4'-methylenebis(oxyethylenethio)diphenol, 4-hydroxy-4-isopropoxydiphenylsulfone, 4-hydroxydiphenylsulfone, 4-hydroxy-4'-methyldiphenylsulfone and like phenolic compounds, p-phenylphenol-formalin resin, p-butylphenol-acetylene resin and like phenolic resins; salts of the organic color acceptor with a metal such as zinc, magnesium, aluminum, calcium, titanium, manganese, tin, nickel or like polyvalent metal; 1,3-diphenyl-2-thiourea, 1,3-dichlorophenyl-2-thiourea and like thiourea compounds; etc. Among these color acceptors, preferable are polyvalent metal salts of aromatic carboxylic acids of the formula [XI] or [XII] below, especially metal salts of indole carboxylic acids of the formula [XII], since these salts give the record images having long-term durability and excellent light resistance.

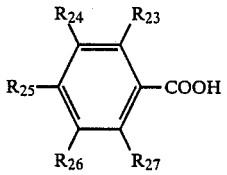

[XI]

wherein $R_{23}\sim R_{27}$ are each hydrogen atom; halogen atom; $C_{1\sim12}$ alkyl unsubstituted or substituted with halogen atom; $C_{5\sim12}$ cycloalkyl; $C_{1\sim12}$ alkoxyl; phenyl unsubstituted or substituted with halogen atom, nitro, $C_{1\sim4}$ alkyl or $C_{1\sim4}$ alkoxyl; naphthyl unsubstituted or substituted with halogen atom, nitro, $C_{1\sim4}$ alkyl or $C_{1\sim4}$ alkoxyl; phenoxy unsubstituted or substituted with halogen atom, nitro, $C_{1\sim4}$ alkyl or $C_{1\sim4}$ alkoxyl; benzyl unsubstituted or substituted with halogen atom, nitro, $C_{1\sim4}$ alkyl or $C_{1\sim4}$ alkoxyl; benzyloxy unsubstituted or substituted with halogen atom, nitro, $C_{1\sim4}$ alkyl or $C_{1\sim4}$ alkoxyl; nitro; cyano; $C_{1\sim4}$ alkylcarbonyl; benzoyl unsubstituted or substituted with halogen atom, $C_{1\sim4}$ alkyl or $C_{1\sim4}$ alkoxyl; hydroxyl; $COOR_{28}$; $CON(R_{29})(R_{30})$; $R_{28}\sim R_{30}$ are each hydrogen atom; $C_{1\sim12}$ alkyl unsubstituted or substituted with halogen atom, $C_{1\sim4}$ alkoxyl or hydroxyl; $C_{5\sim12}$ cycloalkyl unsubstituted or substituted with $C_{1\sim4}$ alkyl; benzyl unsubstituted or substituted with halogen atom, nitro, $C_{1\sim4}$ alkyl or $C_{1\sim4}$ alkoxyl; phenyl unsubstituted or substituted with halogen atom, nitro, $C_{1\sim4}$ alkyl or $C_{1\sim4}$ alkoxyl; naphthyl unsubstituted or substituted with halogen atom, nitro, $C_{1\sim4}$ alkyl or $C_{1\sim4}$ alkoxyl; $R_{29}$ and $R_{30}$ may form together therewith a heteroring selected from the group consisting of pyrrolidine ring, piperidine ring, morpholine ring and hexamethyleneimine ring; $R_{25}$ and $R_{26}$, or $R_{26}$ and $R_{27}$ may form a naphthalene ring together therewith.

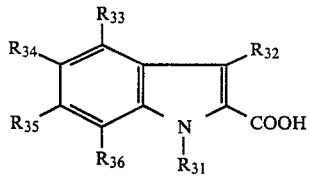

[XII]

wherein $R_{31}$ is hydrogen atom; $C_{1\sim12}$ alkyl unsubstituted or substituted with halogen atom; $C_{5\sim12}$ cycloalkyl; $C_{3\sim12}$ alkenyl unsubstituted or substituted with phenyl; $C_{3\sim12}$ alkynyl unsubstituted or substituted with phenyl; phenyl unsubstituted or substituted with halogen atom, nitro, $C_{1\sim4}$ alkyl, $C_{1\sim4}$ alkoxyl or $C_{1\sim4}$ halogenated alkyl; naphthyl unsubstituted or substituted with halogen atom, nitro, $C_{1\sim4}$ alkyl, $C_{1\sim4}$ alkoxyl or $C_{1\sim4}$ halogenated alkyl; benzyl unsubstituted or substituted with halogen atom, nitro, $C_{1\sim4}$ alkyl or $C_{1\sim4}$ alkoxyl; $C_{1\sim4}$ alkylcarbonyl; benzoyl unsubstituted or substituted with halogen atom, $C_{1\sim4}$ alkyl or $C_{1\sim4}$ alkoxyl; $R_{32}\sim R_{36}$ are each hydrogen atom; $C_{1\sim4}$ alkyl unsubstituted or substituted with halogen atom or $C_{1\sim4}$ alkoxyl; $C_{5\sim6}$ cycloalkyl; phenyl unsubstituted or substituted with halogen atom, nitro, $C_{1\sim4}$ alkyl, $C_{1\sim4}$ alkoxyl or hydroxyl; benzyl unsubstituted or substituted with halogen atom, nitro, $C_{1\sim4}$ alkyl or $C_{1\sim4}$ alkoxyl; $C_{1\sim4}$ alkoxyl; $C_{5\sim6}$ cycloalkyloxy; $C_{3\sim4}$ alkenyloxy unsubstituted or substituted with phenyl; $C_{3\sim4}$ alkynyloxy unsubstituted or substituted with phenyl; phenoxy unsubstituted or substituted with halogen atom, $C_{1\sim4}$ alkyl or $C_{1\sim4}$ alkoxyl; benzyloxy unsubstituted or substituted with halogen atom, $C_{1\sim4}$ alkyl or $C_{1\sim4}$ alkoxyl; $C_{1\sim4}$ alkylcarbonyloxy; benzoyloxy unsubstituted or substituted with halogen atom, $C_{1\sim4}$ alkyl or $C_{1\sim4}$ alkoxyl; $C_{1\sim4}$ alkylcarbonyl; benzoyl unsubstituted or substituted with halogen atom, $C_{1\sim4}$ alkyl or $C_{1\sim4}$ alkoxyl; di($C_{1\sim4}$ alkyl)amino; halogen atom; nitro; cyano; hydroxyl.

Examples of the compounds of the formula [XI] are shown below.

Benzoic acid derivatives such as benzoic acid, o-toluic acid, p-toluic acid, o-chlorobenzoic acid, p-chlorobenzoic acid, o-bromobenzoic acid, p-bromobenzoic acid, 2,4-dichlorobenzoic acid, 3,4-dichlorobenzoic acid, 3,5-dichlorobenzoic acid, 2,6-dichlorobenzoic acid, o-nitrobenzoic acid, p-nitrobenzoic acid, 2,4-dinitrobenzoic acid, 3,4-dinitrobenzoic acid, 3,5-dinitrobenzoic acid, 2,6-dinitrobenzoic acid, 2-chloro-4-nitrobenzoic acid, 2-chloro-5-nitrobenzoic acid, 4-chloro-2-nitrobenzoic acid, 4-chloro-3-nitrobenzoic acid, salicylic acid, 3,5-bis(α-methylbenzyl)salicylic acid, m-hydroxybenzoic acid, p-hydroxybenzoic acid, 2,4-dihydroxybenzoic acid, 3,4-dihydroxybenzoic acid, 3,5-dihydroxybenzoic acid, gallic acid, p-cyanobenzoic acid, m-trifluoromethylbenzoic acid, 2,4-dimethylbenzoic acid, 3,4-dimethylbenzoic acid, 3,5-dimethylbenzoic acid, o-ethoxybenzoic acid, p-ethoxybenzoic acid, 3,5-dimethoxybenzoic acid, p-n-propoxybenzoic acid, 3,4,5-trimethoxybenzoic acid, p-phenoxybenzoic acid, o-phenylbenzoic acid, p-phenylbenzoic acid, o-cumylbenzoic acid, p-cumylbenzoic acid, 2,4-dicumylbenzoic acid, 4,6-dicumylsalicylic acid, p-acetylbenzoic acid, 2-cyclohexylbenzoic acid, 4-(2-phenoxyethoxy)benzoic acid, 4-(p-chlorophenoxy)benzoic acid, 2-benzylbenzoic acid or 4-(p-methylbenzyloxy)benzoic acid.

Naphthoic acid derivatives such as 1-naphthoic acid, 2-naphthoic acid, 1-hydroxy-2-naphthoic acid, 2-hydroxy-1-naphthoic acid or 2-hydroxy-3-naphthoic acid.

Monoester derivatives of phthalic acids such as monomethyl, monoethyl, monopropyl, monobutyl, monostearyl, monobenzyl, mono-p-chlorobenzyl, mono-p-methylphenyl, mono-2,4-dimethylphenyl, mono-p-chlorophenyl, mono-m-methoxyphenyl, mono-p-methoxyphenyl, mono-m-ethoxyphenyl, mono-p-ethoxyphenyl, mono-1-naphthyl, mono-2-naphthyl, monocyclohexyl, mono-2-methylcyclohexyl, mono-3-methylcyclohexyl, mono-2-hydroxyethyl, mono-2-hydroxybutyl, mono-2-hydroxy-1-methylpropyl, mono-4-hydroxybutyl, mono-2,3-dihydroxypropyl, mono-2-(2-hydroxyethoxy)ethyl or mono-p-methylbenzyl ester of phthalic acid, 3-nitrophthalic acid, 4-nitrophthalic acid, 4-chlorophthalic acid, 4-bromophthalic acid, 4,5-dichlorophthalic acid, 3,6-dichlorophthalic acid, tetrachlorophthalic acid, tetrabromophthalic acid or 3,6-dibromo-4,5-dichlorophthalic acid.

Monoamide derivatives of phthalic acids such as mono-N-methyl, mono-N-ethyl, mono-N-butyl, mono-N-cyclohexyl, mono-N-benzyl, mono-N-p-chlorobenzyl, mono-N-p-methylbenzyl, mono-N-phenyl, mono-N-1-naphthyl, mono-N-2-naphthyl, mono-N,N-dimethyl, mono-N,N-diethyl, mono-N-methyl-mono-N-benzyl or mono-N,N-pentamethylene amide of phthalic acid, 3-nitro-phthalic acid, 4-nitrophthalic acid, 3-chlorophthalic acid, 4-chlorophthalic acid, 4-bromophthalic acid, 4,5-dichlorophthalic acid, 3,6-dichlorophthalic acid, tetrachlorophthalic acid, tetrabromophthalic acid or 3,6-dibromo-4,5-dichlorophthalic acid.

The compounds of the formula [XII] include indole-2-carboxylic acid derivatives such as indole-2-carboxylic acid, 1-methylindole-2-carboxylic acid, 3-methylindole-2-carboxylic acid, 5-methylindole-2-carboxylic acid, 6-methylindole-2-carboxylic acid, 1,3-dimethylindole-2-carboxylic acid, 1,5-dimethylindole-2-carboxylic acid, 1-phenylindole-2-carboxylic acid, 3-phenylindole-2-carboxylic acid, 3-(2-hydroxyphenyl)indole-2-carboxylic acid, 1-benzylindole-2-carboxylic acid, 1-allylindole-2-carboxylic acid, 1-propargylindole-2-carboxylic acid, 1-acetylindole-2-carboxylic acid, 3-acetylindole-2-carboxylic acid, 1-benzoylindole-2-carboxylic acid, 3-benzoylindole-2-carboxylic acid, 5-methoxyindole-2-carboxylic acid, 5-ethoxyindole-2-carboxylic acid, 5-phenoxyindole-2-carboxylic acid, 5-(benzyloxy)indole-2-carboxylic acid, 5-(cyclohexyloxy)indole-2-carboxylic acid, 5-acetoxyindole-2-carboxylic acid, 5-(benzoyloxy)indole-2-carboxylic acid, 5-chloroindole-2-carboxylic acid, 4-nitroindole-2-carboxylic acid, 5-nitroindole-2-carboxylic acid, 5-cyanoindole-2-carboxylic acid, 5-hydroxyindole-2-carboxylic acid or 5-(dimethylamino)indole-2-carboxylic acid.

Examples of metals which form a polyvalent metal salt with the aromatic carboxylic acid of the above formula [XI] or [XII] are magnesium, calcium, barium, zinc, aluminum, tin, iron, cobalt, nickel, copper or like polyvalent metal. More preferable are magnesium, calcium, zinc and aluminum, and most preferable is zinc. These metal salts can be used, as required, in mixture of at least two of them.

The present heat-sensitive recording material will be explained in more detail below. Various kinds of heat-sensitive recording materials are disclosed, for example, in Japanese examined patent publication Nos. 3,680/1969, 27,880/1969, 14,039/1970, 43,830/1973, 69/1974, 70/1974, 20,142/1977, etc. The present invention can be applied to these various kinds of heat-sensitive recording materials, and provides the heat-sensitive recording materials which gives the record image having the afore-mentioned excellent characteristics.

Generally, to a medium having dissolved or dispersed a binder therein were added fine particles of the chromeno compound of the formula [I] and the color acceptor to obtain a coating composition. The composition is applied to a suitable substrate such as a paper, plastic film, synthetic paper, non-woven sheet or molding to prepare the present heat-sensitive recording material.

The proportions of the chromeno compound and the color acceptor in the recording layer are not limitative but are usually 1 to 50 parts by weight, preferably 1.5 to 10 parts by weight of the latter per one part by weight of the former.

For preparing the coating composition, the basic dye and the color acceptor are dispersed, together or individually, into water serving as a dispersion medium, using stirrings and pulverizing means such as a ball mill, attritor or sand mill.

To the coating composition is added a binder such as starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, styrene-butadiene copolymer emulsion, etc. The amount of the binder used is 10 to 40% by weight, preferably 15 to 30% by weight, based on the weight of total solids content of the coating composition.

Various other auxiliary agents can be further added to the coating composition. Examples of useful agents are dispersants such as sodium dioctylsulfosuccinate, sodium dodecylbenzenesulfonate, sodium lauryl sulfate, fatty acid metal salts, etc., ultraviolet ray absorbing agents such as triazole compounds, defoaming agents, fluorescent dyes, coloring dyes, antioxidants, etc.

Further, to the composition may be added, in order to prevent sticking upon contact of the heat-sensitive recording paper with a recording device or thermal head, a dispersion or emulsion of stearic acid, polyethylene wax, carnauba wax, paraffin wax, zinc stearate, calcium stearate, ester wax or the like.

Further, to the coating composition may be added in an amount which does not cause adverse effect, various known heat-fusible compounds such as stearic acid amide, stearic acid methylenebisamide, oleic acid amide, palmitic acid amide, coconut fatty acid amide and like aliphatic acid amide; 2,2'-methylene-bis(4-methyl-6-tert-butylphenol), 1,1,3-tris(2-methyl-4-hydroxy-5-tert-butylphenyl)butane and like hindered phenols; 1,2-bis(phenoxy)ethane, 1,2-bis(4-methylphenoxy)ethane, 1,2-bis(3-methylphenoxy)ethane, 2-naphthol benzyl ether and like ethers; dibenzyl terephthalate, 1-hydroxy-2-naphthoic acid phenyl ester and like esters.

In addition, to the composition may be added in order to prevent the adhesion of tailings to the thermal head, inorganic pigment such as kaolin, clay, talc, calcium carbonate, calcined clay, titanium oxide, kieselguhr, finely divided anhydrous silica, activated clay, etc.

As a substrate (support) to be coated, may be used a paper, plastic film, synthetic fiber sheet or the like, but a paper is most preferably used from a viewpoint of cost, coating applicability, etc. The amount of coating composition forming the recording layer to be applied to the support, which is not limited particularly, is usually about 2 to 12 g/m$^2$, preferably about 3 to 10 g/m$^2$, based on dry weight.

The heat-sensitive recording materials thus obtained suit to optical character-reading device and high-speed recording, give record images having excellent characteristics which are resistant to humidity, heat, light, etc. and are free from the fogging in the background.

Although the heat-sensitive recording material using the chromeno compound of the formula [I] as a basic dye exhibits excellent properties, the record images therefrom sometimes fade or disappear by contact with plasticizer in the plastic film or with components contained in the finger print. Thus, the present heat-sensitive recording material is not necessarily enough in resistances to plasticizer and finger print.

The inventors of the present invention have made further investigation and have found, by using amino compound of the formula [XIII] or [XIV] below cojointly with the chromeno compound, the above problems were dissolved and the heat-sensitive recording material was obtained which was excellent in resistances to plasticizer and finger print.

[XIII]

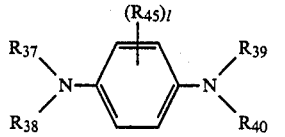

[XIV]

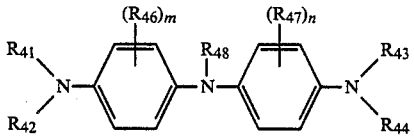

wherein $R_{37}\sim R_{44}$ are each hydrogen atom; $C_{1\sim12}$ alkyl; $C_{5\sim12}$ cycloalkyl; $C_{1\sim4}$ alkoxy-$C_{1\sim4}$ alkyl; $C_{3\sim12}$ alkenyl; $C_{3\sim12}$ alkynyl; benzyl unsubstituted or substituted with halogen atom, nitro, $C_{1\sim4}$ alkyl or $C_{1\sim4}$ alkoxyl; phenyl unsubstituted or substituted with halogen atom, nitro, $C_{1\sim4}$ alkyl, $C_{1\sim4}$ alkoxyl, $C_{1\sim4}$ halogenated alkyl or $C_{6\sim10}$ phenoxy; naphthyl unsubstituted or substituted with halogen atom, nitro, $C_{1\sim4}$ alkyl, $C_{1\sim4}$ alkoxy, $C_{1\sim4}$ halogenated alkyl or $C_{6\sim10}$ phenoxy; $C_{1\sim12}$ alkylcarbonyl; benzoyl unsubstituted or substituted with halogen atom, $C_{1\sim4}$ alkyl or $C_{1\sim4}$ alkoxyl; benzenesulfonyl unsubstituted or substituted with halogen atom, $C_{1\sim4}$ alkyl or $C_{1\sim4}$ alkoxyl; $R_{37}$ and $R_{38}$, $R_{39}$ and $R_{40}$, $R_{41}$ and $R_{42}$, and $R_{43}$ and $R_{44}$ may form together therewith or with an adjacent benzene ring a heteroring selected from the group consisting of pyrrolidine ring, piperidine ring, morpholine ring, hexamethyleneimine ring and tetrahydroquinoline ring; $R_{45}\sim R_{47}$ are each halogen atom; $C_{1\sim4}$ alkyl; $C_{1\sim4}$ alkoxyl, $R_{48}$ is hydrogen atom; $C_{1\sim4}$ alkyl; phenyl unsubstituted or substituted with halogen atom, $C_{1\sim4}$ alkyl, $C_{1\sim4}$ alkoxyl or di($C_{1\sim4}$ alkyl)amino; naphthyl unsubstituted or substituted with halogen atom, $C_{1\sim4}$ alkyl, $C_{1\sim4}$ alkoxyl or di($C_{1\sim4}$ alkyl)amino, l, m and n are each an integer of $0\sim2$.

Examples of the amino compounds of the formula [XIII] are N,N'-di-β-naphthyl-p-phenylenediamine, N-phenyl-N'-cyclohexyl-p-phenylenediamine, N-isopropyl-N'-phenyl-p-phenylenediamine, N,N'-diphenyl-p-phenylene-diamine, N,N'-di-o-tolyl-p-phenylenediamine, N,N'-di-m-tolyl-p-phenylenediamine, N,N'-di-p-tolyl-p-phenylenediamine, N,N'-di(2,4-dimethylphenyl)-p-phenylenediamine, N,N'-diallyl-p-phenylenediamine, N-(1,3-dimethylbutyl)-N'-phenyl-p-phenylenediamine, N-butyl-N'-phenyl-p-phenylenediamine, N-hexyl-N'-allyl-p-phenylenediamine, N,N'-diisobutyl-p-phenylenediamine, N,N'-diisooctyl-p-phenylenediamine, N,N'-di(1-ethyl-3-methylpentyl)-p-phenylenediamine, N,N'-di(1,4-dimethyl-pentyl)-p-phenylenediamine, N,N'-di(1,3-dimethylbutyl)-p-phenylenediamine, N,N'-diisopropyl-p-phenylenediamine and N-phenyl-N'-4-toluenesulfonyl-p-phenylenediamine.

The amino compounds of the formula [XIV] include 4,4'-dianilinodiphenylamine, 4,4'-bis(4-chloroanilino)diphenylamine, 4,4'-bis(4-toluidino)diphenylamine, 4,4'-bis(3-toluidino)diphenylamine, 4,4'-bis(3-chloro-4-methylanilino)diphenylamine, 4,4'-di-β-naphthylaminodiphenylamine, 4,4'-bis(p-phenetidino)diphenylamine, 4-anilino-4'-toluidino-diphenylamine, 4,4'-bis(dimethylamino)-diphenylamine, 4,4'-bis(diethylamino)diphenylamine, 4,4'-bis(dibenzylamino)diphenylamine, 4,4'-bis(morpholino)diphenylamine, 4,4'-bis(N-methyl-N-ethylamino)diphenylamine, 4,4'-bis(N-ethyl-N-cyclohexylamino)diphenylamine, 4,4'-bis(N-methyl-N-phenylamino)diphenylamine, 4,4'-bis(N-allyl-N-methylamino)diphenylamine, 4-dimethylamino-4'-anilinodiphenylamine, 4-diethylamino-4'-anilinodiphenylamine, 4-(N-methyl-p-tolylamino)-4'-anilinodiphenylamine, 4-(N-ethyl-p-tolylamino)-4'-anilinodiphenylamine, 4-(N-ethyl-N-benzylamino)-4'-anilinodiphenylamine, 4-(N-ethyl-N-cyclohexylamino)-4'-anilinodiphenylamine, 4-(N-ethyl-N-cyclododecylamino)-4'-anilinodiphenylamine, 4-N-cyclododecylamino-4'-anilinodiphenylamine, 4-N-β-ethoxyethylamino-4'-anilinodiphenylamine, 4-N-p-phenoxyphenylamino-4'-anilinodiphenylamine, 4-N-benzoylamino-4'-anilinodiphenylamine and 4-N-p-toluenesulfonylamino-4'-anilinodiphenylamine.

These amino compounds can be used singly or in mixture of at least two of them. Among the above amino compounds, more preferable is the compound of the formula [XIII'] or [XIV'] below, especially the compound of the formula [XIII''] or [XIV''] below which is excellent in the contemplated effect, and most preferable is N,N'-di-β-naphthyl-p-phenylenediamine which is colorless and does not change in color, thereby more excellent desired effect is achieved.

[XIII']

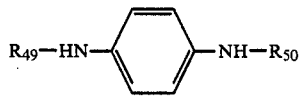

[XIV']

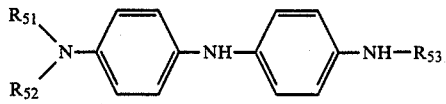

wherein $R_{49}$, $R_{50}$ and $R_{53}$ are each phenyl unsubstituted or substituted with halogen atom, $C_{1\sim4}$ alkyl, $C_{1\sim4}$ alkoxyl or $C_{6\sim10}$ phenoxy; naphthyl unsubstituted or substituted with halogen atom, $C_{1\sim4}$ alkyl, $C_{1\sim4}$ alkoxyl or $C_{6\sim10}$ phenoxy; $R_{51}$ and $R_{52}$ are each hydrogen atom; $C_{1\sim4}$ alkyl; phenyl unsubstituted or substituted with halogen atom, $C_{1\sim4}$ alkyl, $C_{1\sim4}$ alkoxyl or $C_{6\sim10}$ phenoxy; naphthyl unsubstituted or substituted with halogen atom, $C_{1\sim4}$ alkyl, $C_{1\sim4}$ alkoxyl or $C_{6\sim10}$ phenoxy.

[XIII"]

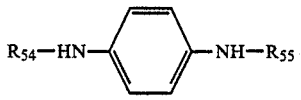

[XIV"]

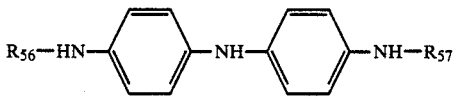

wherein $R_{54}\sim R_{57}$ are each phenyl unsubstituted or substituted with methyl; naphthyl unsubstituted or substituted with methyl.

In the present invention, the amount of the above amino compound is not limited particularly, but is usually 0.05 to 10 parts by weight, preferably 0.1 to 3 parts by weight per one part by weight of the chromeno compound.

Further, it is possible to form an over-coat layer on the recording layer to protect the layer. Various other known techniques in the field of heat-sensitive recording material can be applied. For example, it is possible to form a protect layer on the rear surface of the support, to form a primary coating layer on the support.

The invention will be described below in more detail with reference to Preparation Examples of chromeno compounds and Examples by no means limited to, in which parts and percentages are all by weight, unless otherwise specified.

Preparation Example 1

Synthesis of
3,6-bis(diethylamino)-spiro[fluorene-9,6'-6'H-chromeno(4,3-b)indole]

To a solution of 4 g of 3,6-bis(diethylamino)fluorenone in 320 ml of ethanol and 32 ml of conc. hydrochloric acid was added 3.8 g of 2-(2-hydroxyphenyl)indole and the mixture was reacted with heating at a reflux temperature for 7 hours. The reaction mixture was poured into 2 l of water and was neutralized with addition of sodium hydroxide to obtain precipitates. The precipitates were filtered and recrystallized from methanol to give 4.78 g (yield 75%) of white crystal having m.p. of 249°~251° C. This chromeno compound formed blue image upon contact with silica gel.

Preparation Example 2

Synthesis of
3,6-bis(pyrrolidino)-spiro[fluorene-9,6'-6'H-chromeno(4,3-b)indole]

To a solution of 3 g of 3,6-bis(pyrrolidino)fluorenone in 200 ml of ethanol and 20 ml of conc. hydrochloric acid was added 2.9 g of 2-(2-hydroxyphenyl)indole and the mixture was reacted with heating at a reflux temperature for 4 hours. The reaction mixture was poured into 1 l of water and was neutralized with addition of sodium hydroxide to obtain precipitates. The precipitates were filtered and recrystallized from ethanol to give 3.1 g (yield 65%) of pale-yellow crystal having m.p. of 266°~270° C. This chromeno compound formed dark blue image upon contact with silica gel.

Preparation Example 3

Synthesis of
3,6-bis(dimethylamino)-spiro[fluorene-9,6'-6'H-chromeno(4,3-b)-1-azaindolizine]

To a solution of 3 g of 3,6-bis(dimethylamino)fluorenone in 90 ml of N-methyl-2-pyrrolidone was added 3.6 g of 1H-2-(2-hydroxyphenyl)-1-azaindolizinium perchlorate and the mixture was reacted at room temperature for 5 hours. The reaction mixture was poured into 400 ml of water and was neutralized with addition of sodium hydroxide to obtain precipitates. The precipitates were filtered and recrystallized from methanol to give 2.1 g (yield 40%) of white crystal having m.p. of 262°~267° C. This chromeno compound formed blue image upon contact with silica gel.

Preparation Example 4

Synthesis of
3,6-bis(N-methyl-N-ethylamino)-spiro-[fluorene-9,6'-6'H-chromeno(4,3-b)indole]

White crystal (3.8 g) having m.p. 255°~260° C. was obtained in a yield of 71% in the same manner as in Preparation Example 1 except that 3.2 g of 3,6-bis(N-methyl-N-ethylamino)fluorenone was used in place of 3,6-bis(diethylamino)fluorenone. This chromeno compound formed blue image upon contact with silica gel.

Preparation Example 5

Synthesis of
3,6-bis(N-methyl-N-n-propylamino)-spiro[fluorene-9,6'-6'H-chromeno(4,3-b)indole]

White crystal (4.65 g) having m.p. of 201°~204° C. was obtained in a yield of 72% in the same manner as in Preparation Example 1 except that 4.2 g of 3,6-bis(N-methyl-N-n-propylamino)fluorenone was used in place of 3,6-bis(diethylamino)fluorenone. This chromeno compound formed blue image upon contact with silica gel.

Preparation Example 6

Synthesis of
3,6-bis(N-methyl-N-cyclohexylamino)-spiro[fluorene-9,6'-6'H-chromeno(4,3-b)indole]

White crystal (4.6 g) having m.p. of 244°~248° C. was obtained in a yield of 64% in the same manner as in Preparation Example 1 except that 4.9 g of 3,6-bis(N-methyl-N-cyclohexylamino)fluorenone was used in place of 3,6-bis(diethylamino)fluorenone. This chromeno compound formed blue image upon contact with silica gel.

Preparation Example 7

Synthesis of
3,6-bis(diethylamino)-spiro[fluorene-9,6'-6'H-8'-methyl-chromeno(4,3-b)indole]

White crystal (4.1 g) having m.p. of 211°~215° C. was obtained in a yield of 63% in the same manner as in Preparation Example 1 except that 4.1 g of 2-(2-hydroxyphenyl)-5-methylindole was used in place of 2-(2-hydroxyphenyl)indole. This chromeno compound formed blue image upon contact with silica gel.

Preparation Example 8

Synthesis of 3,6-bis(diethylamino)-8'-dimethylamino-spiro[fluorene-9,6'-6'H-chromeno(4,3-d)thiazole]

White crystal (4.5 g) which is recrystallized from ethanol and has m.p. of 201°~204° C. was obtained in a yield of 69% in the same manner as in Preparation Example 1 except that 3.6 g of 2-dimethylamino-4-(2-hydroxyphenyl)thiazole was used in place of 2-(2-hydroxyphenyl)indole. This chromeno compound formed bluish green image upon contact with silica gel.

Preparation Example 9

Synthesis of 3,6-bis(dimethylamino)-2'-methyl-spiro[fluorene-9,6'-6'H-chromeno(3,4-a)-3-azaindolizine]

White crystal (2.9 g) which is recrystallized from ethanol and has m.p. of 209°~213° C. was obtained in a yield of 54% in the same manner as in Preparation Example 3 except that 3.7 g of 2-(2-hydroxy-5-methylphenyl)-3-azaindolizine was used in place of 1H-2-(2-hydroxyphenyl)-1-azaindolizinium perchlorate. This chromeno compound formed blue image upon contact with silica gel.

Preparation Example 10

Synthesis of 3,6-bis(diethylamino)-7'-methyl-8'-phenyl-spiro[fluorene-9,6'-6'H-chromeno(4,3-c)pyrazole]

White crystal (4.7 g) which is recrystallized from ethanol and has m.p. of 225°~229° C. was obtained in a yield of 68% in the same manner as in Preparation Example 1 except that 4.5 g of 2-phenyl-3-methyl-5-(2-hydroxyphenyl)pyrazole was used in place of 2-(2-hydroxyphenyl)indole. This chromeno compound formed bluish green image upon contact with silica gel.

Preparation Example 11

Synthesis of 3,6-bis(diethylamino)-7'-methyl-9'-phenyl-spiro[fluorene-9,6'-6'H-chromeno(3,4-d)pyrazole]

White crystal (4.2 g) which is recrystallized from ethanol and has m.p. of 211°~214° C. was obtained in a yield of 61% in the same manner as in Preparation Example 1 except that 4.5 g of 1-phenyl-3-methyl-5-(2-hydroxyphenyl)pyrazole was used in place of 2-(2-hydroxyphenyl)indole. This chromeno compound formed bluish green image upon contact with silica gel.

Preparation Examples 12 to 52

Chromeno compounds listed in Table 1 and each comprising one of the groups (a) to (f) were prepared in the same manner as in Preparation Example 1. Table 1 also shows melting point and color when contacted with silica gel of each of the products. In item $R^1$ to $R^4$ of Table 1, p-Cl-Bz means p-chlorobenzyl. In item 1' ~ 11' all of the positions were occupied by hydrogen atom(s) unless otherwise specified. In item of color, B means blue, BG bluish green and BB blackish blue.

TABLE 1

| Prep. Ex. | group | $R_1$ | $R_2$ | $R_3$ | $R_4$ | $R_5 \sim R_{11}$ | 1′~11′ | m.p. (°C.) | color |
|---|---|---|---|---|---|---|---|---|---|
| 12 | (a) | n-$C_4H_9$— | n-$C_4H_9$— | n-$C_4H_9$— | n-$C_4H_9$— | $R_5$ = H | | 158~161 | B |
| 13 | (a) | p-Cl—Bz— | p-Cl—Bz— | p-Cl—Bz— | p-Cl—Bz— | $R_5$ = H | | — | B |
| 14 | (a) | $CH_3$— | $CH_2$=$CHCH_2$— | $CH_2$=$CHCH_2$— | $CH_3$— | $R_5$ = H | | 252~255 | B |
| 15 | (a) | iso-$C_3H_7$— | $C_2H_5$— | iso-$C_3H_7$— | $C_2H_5$— | $R_5$ = H | | 203~205 | B |
| 16 | (a) | $CH_3$— | $CH_3$— | $C_2H_5$— | $C_2H_5$— | $R_5$ = H | | 262~265 | B |
| 17 | (a) | $CH_3$— | $CH_3$— | —$(CH_2)_4$— | | $R_5$ = H | | 266~271 | B |
| 18 | (a) | $C_2H_5$— | $C_2H_5$— | $C_2H_5$— | $C_2H_5$— | $R_5$ = $CH_3$ | | 251~254 | B |
| 19 | (a) | $CH_3$— | $CH_3$— | $CH_3$— | $CH_3$— | $R_5$ = H | 2′ = $CH_3$ | 270~273 | B |
| 20 | (a) | $CH_3$— | $CH_3$— | $CH_3$— | $CH_3$— | $R_5$ = H | 8′ = Cl | 265~270 | B |
| 21 | (a) | $CH_3O$—$C_2H_4$— | $CH_3$— | $CH_3O$—$C_2H_4$— | $CH_3$— | $R_5$ = H | | 157~161 | B |
| 22 | (a) | cyclohexyl | $C_2H_5$— | cyclohexyl | $C_2H_5$— | $R_5$ = H | | 250~253 | B |
| 23 | (a) | p-tolyl | $C_2H_5$— | p-tolyl | $C_2H_5$— | $R_5$ = $CH_3$ | | 233~237 | B |
| 24 | (a) | $CH_3$— | $CH_3$— | $CH_3$— | $CH_3$— | $R_5$ = H | 2′ = $C_6H_5$— | 296~298 | BB |
| 25 | (a) | $C_2H_5$— | $C_2H_5$— | $C_2H_5$— | $C_2H_5$— | $R_5$ = H | 2′ = $CH_2$—, 4′ = $CH_3$— | 261~264 | B |
| 26 | (a) | $C_2H_5$— | $C_2H_5$— | $C_2H_5$— | $C_2H_5$— | $R_5$ = H | 2′ = $C_6H_5CH_2$— | 231~237 | B |
| 27 | (a) | $C_2H_5$— | $C_2H_5$— | $C_2H_5$— | $C_2H_5$— | $R_5$ = H | 3′ = $CH_3$— | 257~262 | B |
| 28 | (a) | $C_2H_5$— | $C_2H_5$— | $C_2H_5$— | $C_2H_5$— | $R_5$ = H | 2′ = $(C_2H_5)_2N$— | 276~279 | B |
| 29 | (b) | $C_2H_5$— | $C_2H_5$— | $C_2H_5$— | $C_2H_5$— | — | | 211~214 | BG |
| 30 | (b) | —$(CH_2)_2O(CH_2)_2$— | | —$(CH_2)_2O(CH_2)_2$— | | — | | — | BG |
| 31 | (b) | $(CH_3)_2CH(CH_2)_2$— | $CH_3$— | $(CH_3)_2CH(CH_2)_2$— | $CH_3$— | — | 2′ = $CH_3$ | 164~166 | BG |
| 32 | (c) | $CH_3$— | $CH_3$— | $CH_3$— | $CH_3$— | — | | 242~245 | BG |
| 33 | (c) | $C_2H_5$— | $C_2H_5$— | $C_2H_5$— | $C_2H_5$— | — | 2′ = $C_2H_5$ | 207~211 | BG |
| 34 | (c) | $C_6H_5C_2H_4$— | $C_2H_5$— | $C_6H_5C_2H_4$— | $C_2H_5$— | — | | — | B |
| 35 | (d) | $CH_3$— | $C_6H_5$— | $CH_3$— | $C_6H_5$— | $R_6$ = $R_7$ = $CH_3$ | | 227~231 | B |
| 36 | (d) | $C_2H_5$— | $C_2H_5$— | $C_2H_5$— | $C_2H_5$— | $R_6$ = $R_7$ = $C_2H_5$ | | 199~204 | B |
| 37 | (d) | $C_2H_5$— | $C_2H_5$— | $C_2H_5$— | $C_2H_5$— | $R_6$ = $R_7$ = $CH_3$ | 3′ = $CH_3$ | 205~208 | B |
| 38 | (d) | $CH_3$— | $CH_3$— | —$(CH_2)_4$— | | $R_6$ $R_7$: —$(CH_2)_4$— | | — | B |
| 39 | (e) | $CH_3$— | $CH_3$— | $CH_3$— | $CH_3$— | $R_6$ = $CH_3$, $R_9$ = $C_6H_5$ | | 255~260 | BG |
| 40 | (e) | $CH_3$— | $CH_3$— | $CH_3$— | $CH_3$— | $R_8$ = $CH_3$, $R_9$ = $C_6H_5$ | 1′ = $CH_3$ | 247~261 | BG |
| 41 | (e) | $C_6H_5CH_2$— | $C_6H_5CH_2$— | $C_6H_5CH_2$— | $C_6H_5CH_2$— | $R_8$ = $CH_3$, $R_9$ = $C_6H_5$ | | — | BG |
| 42 | (e) | $C_2H_5$— | $C_2H_5$— | $C_2H_5$— | $C_2H_5$— | $R_8$ = $CH_3$, $R_9$ = p-tolyl | | 239~242 | BG |
| 43 | (e) | $C_2H_5$— | $C_2H_5$— | $C_2H_5$— | $C_2H_5$— | $R_8$ = $CH_3$, $R_9$ = $C_2H_5$ | | 222~230 | BG |
| 44 | (e) | $CH_3$— | $C_2H_5$— | $CH_3$— | $C_2H_5$— | $R_8$ = $C_2H_5$, $R_9$ = p-tolyl | | 155~165 | BG |
| 45 | (e) | $CH_3$— | $CH_3$— | $CH_3$— | $CH_3$— | $R_8$ = $R_9$ = $C_6H_5$ | | 147~160 | BG |
| 46 | (f) | $CH_3$— | $CH_3$— | $CH_3$— | $CH_3$— | $R_{10}$ = $CH_3$, $R_{11}$ = $C_2H_5$ | | 250~255 | BG |
| 47 | (f) | $C_2H_5$— | $C_2H_5$— | $C_2H_5$— | $C_2H_5$— | $R_{10}$ = $CH_3$, $R_{11}$ = $C_6H_5$ | 1′ = $OCH_3$ | 230~232 | BG |
| 48 | (f) | $CH_3$— | $CH_3$— | $C_2H_5$— | $C_2H_5$— | $R_{10}$ = $CH_3$, $R_{11}$ = $C_2H_5$ | | 231~235 | BG |
| 49 | (f) | $C_2H_5$— | $C_2H_5$— | $C_2H_5$— | $C_2H_5$— | $R_{10}$ = H, $R_{11}$ = $C_2H_5$ | | 211~217 | BG |
| 50 | (f) | cyclopentyl | $CH_3$— | cyclopentyl | $CH_3$— | $R_{10}$ = H, $R_{11}$ = $C_6H_5$ | | — | BG |
| 51 | (f) | n-$C_3H_7$— | n-$C_3H_7$— | n-$C_3H_7$— | n-$C_3H_7$— | $R_{10}$ = $CH_3$, $R_{11}$ = $C_6H_5CH_2$— | 1′ = $CH_3$ | 184~188 | BG |
| 52 | (f) | n-$C_4H_9$— | n-$C_4H_9$— | n-$C_4H_9$— | n-$C_4H_9$— | $R_{10}$ = $CH_3$, $R_{11}$ = $C_2H_5$ | 2′ = $CH_3$ | 156~161 | BG |

Examples 1 to 11

Each of heat-sensitive recording papers was prepared in the following method with use of chromeno compounds of Preparation Examples 1 to 11 as listed in Table 2.

Preparation of Composition (A)

| | |
|---|---|
| chromeno compound of each example | 10 parts |
| 5% aqueous solution of methyl cellulose | 5 parts |
| water | 40 parts |

The above components were pulverized by a sand mill to prepare Composition (A) having an average particle size of 3 μm.

Preparation of Composition (B)

| | |
|---|---|
| 4,4'-isopropylidenediphenol | 20 parts |
| 5% aqueous solution of methyl cellulose | 5 parts |
| water | 55 parts |

The above components were pulverized by a sand mill to prepare Composition (B) having an average particle size of 3 μm.

Preparation of Composition (C)

| | |
|---|---|
| stearic acid amide | 20 parts |
| 5% aqueous solution of methyl cellulose | 5 parts |
| water | 55 parts |

The above components were pulverized by a sand mill to prepare Composition (C) having an average particle size of 3 μm.

Preparation of a recording layer

A 55-part quantity of Composition (A), 80 parts of Composition (B), 80 parts of Composition (C), 15 parts of finely divided anhydrous silica (oil absorption 180 ml/100 g), 50 parts of 20% aqueous solution of oxidized starch and 10 parts of water were mixed with stirring to prepare a coating composition. The coating composition was applied to a paper substrate weighing 50 g/m$^2$ in an amount of 6 g/m$^2$ by dry weight to prepare a heat-sensitive recording paper.

Examples 12 to 22

Each of heat-sensitive recording papers was prepared in the following method with use of chromeno compounds of Preparation Examples 1 to 11 as listed in Table 2.

Preparation of Composition (A)

| | |
|---|---|
| chromeno compound of each example | 10 parts |
| 5% aqueous solution of methyl cellulose | 5 parts |
| water | 40 parts |

The above components were pulverized by a sand mill to prepare Composition (A) having an average particle size of 3 μm.

Preparation of Composition (B)

| | |
|---|---|
| zinc indole-2-carboxylate | 30 parts |
| 5% aqueous solution of methyl cellulose | 5 parts |
| water | 55 parts |

The above components were pulverized by a sand mill to prepare Composition (B) having an average particle size of 3 μm.

Preparation of Composition (C)

| | |
|---|---|
| stearic acid amide | 30 parts |
| 5% aqueous solution of methyl cellulose | 5 parts |
| water | 55 parts |

The above components were pulverized by a sand mill to prepare Composition (C) having an average particle size of 3 μm.

Preparation of Composition (D)

| | |
|---|---|
| 3-(N—cyclohexyl-N—methylamino)-6-methyl-7-anilinofluoran | 5 parts |
| 5% aqueous solution of methyl cellulose | 5 parts |
| water | 40 parts |

The above components were pulverized by a sand mill to prepare Composition (D) having an average particle size of 3 μm.

Preparation of a recording layer

A 55-part quantity of Composition (A), 90 parts of Composition (B), 90 parts of Composition (C), 50 parts of Composition (D), 15 parts of finely divided anhydrous silica (oil absorption 180 ml/100 g), 50 parts of 20% aqueous solution of oxidized starch and 10 parts of water were mixed with stirring to prepare a coating composition. The coating composition was applied to a paper substrate weighing 50 g/m$^2$ in an amount of 6 g/m$^2$ by dry weight to prepare a heat-sensitive recording paper.

The obtained twenty two kinds of the heat-sensitive recording papers were checked for quality and the results were given in Table 2.

1. Color fogging in the background area over the near infrared region

The optical density of the recording layer surface before recording was measured at a wavelength of 850 nm with use of a spectrophotometer.

2. Color forming ability over the near infrared region

The recording paper was pressed to a plate heated at 120° C. at a pressure of 4 kg/cm$^2$ for 5 seconds to produce record images. The optical density (initial density) of the resulting blue record images was measured in the same manner as in the above 1.

3. Resistance to humidity over the near infrared region

The recording paper obtained after tested in the above color forming ability was allowed to stand at 40° C., 90% RH for 24 hours. Thereafter the optical density (density resistant to humidity) was measured in the same manner as in the above 1.

4. Resistance to heat over the near infrared region

The recording paper obtained after tested in the above color forming ability was allowed to stand at 60° C. for 16 hours. Thereafter the optical density (density resistant to heat) was measured in the same manner as in the above 1.

5. Resistance to light over the near infrared region

The recording paper obtained after tested in the above color forming ability was allowed to expose directly to sunlight for 16 hours. Thereafter the optical density (density resistant to light) was measured in the same manner as in the above 1.

Further, Table 2 shows rate of color fading (%) which is calculated by the following equation.

$$\text{rate of color fading (\%)} = \frac{A - B}{A} \times 100$$

A: Initial density

B: Density resistant to humidity, heat or light

In Table 2, DRHm, DRHt and DRL mean respectively density resistant to humidity, heat and light, and RCF(%) means rate of color fading (%).

TABLE 2

| | chromeno compound (Prep. Ex. No.) | optical density in test 1 | initial density in test 2 | resistance to humidity | | resistance to heat | | resistance to light | |
|---|---|---|---|---|---|---|---|---|---|
| | | | | DRHm | RCF (%) | DRHt | RCF(%) | DRL | RCF(%) |
| Ex. 1 | 1 | 0.02 | 0.92 | 0.88 | 4.3 | 0.88 | 4.3 | 0.71 | 22.8 |
| Ex. 2 | 2 | 0.02 | 0.91 | 0.87 | 4.4 | 0.88 | 3.3 | 0.72 | 20.8 |
| Ex. 3 | 3 | 0.05 | 0.92 | 0.88 | 4.3 | 0.87 | 5.4 | 0.70 | 23.9 |
| Ex. 4 | 4 | 0.04 | 0.90 | 0.86 | 4.4 | 0.86 | 4.4 | 0.69 | 23.3 |
| Ex. 5 | 5 | 0.03 | 0.91 | 0.85 | 6.6 | 0.84 | 7.7 | 0.69 | 24.2 |
| Ex. 6 | 6 | 0.02 | 0.92 | 0.86 | 6.5 | 0.85 | 7.6 | 0.73 | 20.6 |
| Ex. 7 | 7 | 0.03 | 0.92 | 0.83 | 9.8 | 0.83 | 9.8 | 0.71 | 22.8 |
| Ex. 8 | 8 | 0.03 | 0.92 | 0.84 | 8.7 | 0.84 | 8.7 | 0.73 | 20.6 |
| Ex. 9 | 9 | 0.04 | 0.91 | 0.85 | 6.6 | 0.84 | 7.7 | 0.74 | 18.7 |
| Ex. 10 | 10 | 0.03 | 0.91 | 0.85 | 6.6 | 0.85 | 6.6 | 0.73 | 19.8 |
| Ex. 11 | 11 | 0.02 | 0.91 | 0.84 | 7.7 | 0.84 | 7.7 | 0.74 | 18.7 |
| Ex. 12 | 1 | 0.02 | 0.93 | 0.89 | 4.3 | 0.89 | 4.3 | 0.92 | 1.1 |
| Ex. 13 | 2 | 0.02 | 0.92 | 0.90 | 2.1 | 0.90 | 2.1 | 0.90 | 2.1 |
| Ex. 14 | 3 | 0.04 | 0.92 | 0.88 | 4.3 | 0.88 | 4.3 | 0.89 | 3.3 |
| Ex. 15 | 4 | 0.04 | 0.91 | 0.87 | 4.4 | 0.86 | 5.5 | 0.89 | 2.2 |
| Ex. 16 | 5 | 0.03 | 0.92 | 0.89 | 3.3 | 0.89 | 3.3 | 0.91 | 1.1 |
| Ex. 17 | 6 | 0.02 | 0.92 | 0.88 | 4.3 | 0.87 | 5.4 | 0.91 | 1.1 |
| Ex. 18 | 7 | 0.02 | 0.93 | 0.88 | 5.4 | 0.87 | 6.5 | 0.92 | 1.1 |
| Ex. 19 | 8 | 0.02 | 0.93 | 0.87 | 6.5 | 0.87 | 6.5 | 0.92 | 1.1 |
| Ex. 20 | 9 | 0.03 | 0.92 | 0.86 | 6.5 | 0.86 | 6.5 | 0.91 | 1.1 |
| Ex. 21 | 10 | 0.03 | 0.93 | 0.87 | 6.5 | 0.86 | 7.5 | 0.91 | 2.2 |
| Ex. 22 | 11 | 0.02 | 0.93 | 0.87 | 6.5 | 0.86 | 7.5 | 0.90 | 3.2 |

Example 23

A heat-sensitive recording paper was prepared in the same manner as in Example 3 except that, in the preparation of Composition (B), zinc p-nitrobenzoate was used in place of zinc indole-2-carboxylate. The obtained recording paper was pressed to a plate heated at 120° C. at a pressure of 4 kg/cm$^2$ for 5 seconds to give dark blue record images. The record images were excellent in resistances to heat and humidity and have strong light absorbency at 480 nm and broad light absorbency at 630~900 nm. Further, when the record images were exposed directly to sunlight for 16 hours, rate of color fading was 3.5% which showed the record images have excellent resistance to light.

Examples 24 to 45

Twenty two kinds of heat-sensitive recording papers were prepared in the same manner as in Example 1 with the exception of using the chromeno compounds listed in Table 3. The obtained heat-sensitive recording papers were tested in the same manner as in Example 1 for color fogging in the background area and color forming ability over the near infrared region which correspond to the above test 1 and test 2. The results were shown in Table 3.

TABLE 3

| | chromeno compound (Prep. Ex. No.) | optical density in test 1 | initial density in test 2 |
|---|---|---|---|
| Ex. 24 | 13 | 0.02 | 0.91 |
| 25 | 14 | 0.03 | 0.92 |
| 26 | 17 | 0.02 | 0.91 |

TABLE 3-continued

| | chromeno compound (Prep. Ex. No.) | optical density in test 1 | initial density in test 2 |
|---|---|---|---|
| 27 | 19 | 0.02 | 0.90 |
| 28 | 20 | 0.03 | 0.92 |
| 29 | 21 | 0.02 | 0.91 |
| 30 | 23 | 0.03 | 0.92 |
| 31 | 24 | 0.03 | 0.92 |
| 32 | 26 | 0.03 | 0.92 |
| 33 | 28 | 0.02 | 0.92 |
| 34 | 30 | 0.04 | 0.93 |
| 35 | 31 | 0.03 | 0.91 |
| 36 | 34 | 0.03 | 0.92 |
| 37 | 35 | 0.02 | 0.90 |
| 38 | 37 | 0.02 | 0.91 |
| 39 | 38 | 0.02 | 0.92 |
| 40 | 41 | 0.03 | 0.92 |
| 41 | 42 | 0.03 | 0.92 |
| 42 | 45 | 0.02 | 0.90 |
| 43 | 47 | 0.02 | 0.91 |
| 44 | 50 | 0.02 | 0.91 |
| 45 | 52 | 0.04 | 0.92 |

Example 46

Preparation of Composition (A)

| | |
|---|---|
| chromeno compound of Preparation Example 1 | 10 parts |
| 5% aqueous solution of methyl cellulose | 5 parts |
| water | 40 parts |

The above components were pulverized by a sand mill to prepare Composition (A) having an average particle size of 3 μm.

Preparation of Composition (B)

| | |
|---|---|
| 4-hydroxy-4'-isopropoxydiphenylsulfone | 20 parts |
| 5% aqueous solution of methyl cellulose | 5 parts |
| water | 55 parts |

The above components were pulverized by a sand mill to prepare Composition (B) having an average particle size of 3 μm.

Preparation of Composition (C)

| | |
|---|---|
| 1,2-bis(3-methylphenoxy)ethane | 20 parts |
| N,N'—diphenyl-p-phenylenediamine | 1 part |
| 5% aqueous solution of methyl cellulose | 5 parts |
| water | 55 parts |

The above components were pulverized by a sand mill to prepare Composition (C) having an average particle size of 3 μm.

Preparation of a recording layer

A 55-part quantity of Composition (A), 80 parts of Composition (B), 81 parts of Composition (C), 15 parts of finely divided anhydrous silica (oil absorption 180 ml/100 g), 50 parts of 20% aqueous solution of oxidized starch and 10 parts of water were mixed with stirring to prepare a coating composition. The coating composition was applied to a paper substrate weighing 50 g/m$^2$ in an amount of 6 g/m$^2$ by dry weight to prepare a heat-sensitive recording paper.

Example 47

A heat-sensitive recording paper was prepared in the same manner as in Example 46 except that one part of N,N'-di-β-naphthyl-p-phenylenediamine was used in place of one part of N,N'-diphenyl-p-phenylenediamine.

Example 48

A heat-sensitive recording paper was prepared in the same manner as in Example 46 except that 3 parts of N,N'-di-p-tolyl-p-phenylenediamine was used in place of one part of N,N'-diphenyl-p-phenylenediamine.

Example 49

A heat-sensitive recording paper was prepared in the same manner as in Example 47 except that 10 parts of chromeno compound of Preparation Example 4 was used in place of 10 parts of chromeno compound of Preparation Example 1.

Example 50

A heat-sensitive recording paper was prepared in the same manner as in Example 47 except that 10 parts of chromeno compound of Preparation Example 3 was used in place of 10 parts of chromeno compound of Preparation Example 1.

Example 51

A heat-sensitive recording paper was prepared in the same manner as in Example 46 except that 3 parts of N,N'-di-β-naphthyl-p-phenylenediamine was used in place of one part of N,N'-diphenyl-p-phenylenediamine.

Example 52

Preparation of Composition (D)

| | |
|---|---|
| 3-(N—cyclohexyl-N—methylamino)-6-methyl-7-anilinofluoran | 10 parts |
| 5% aqueous solution of methyl cellulose | 5 parts |
| water | 40 parts |

The above components were pulverized by a sand mill to prepare Composition (D) having an average particle size of 3 μm.

Preparation of a recording layer

A 27.5-part quantity of Composition (A), 80 parts of Composition (B), 81 parts of Composition (C), these Compositions (A) to (C) being same as those obtained in Example 46, 27.5 parts of the above Composition (D), 15 parts of finely divided anhydrous silica (oil absorption 180 ml/100 g), 50 parts of 20% aqueous solution of oxidized starch and 10 parts of water were mixed with stirring to prepare a coating composition. The coating composition was applied to a paper substrate weighing 50 g/m$^2$ in an amount of 6 g/m$^2$ by dry weight to prepare a heat-sensitive recording paper.

Example 53

A heat-sensitive recording paper was prepared in the same manner as in Example 52 except that 2 parts of 4,4'-dianilinodiphenylamine was used in place of one part of N,N'-diphenyl-p-phenylenediamine.

Example 54

A heat-sensitive recording paper was prepared in the same manner as in Example 46 except that one part of N,N'-diphenyl-p-phenylenediamine was not used.

Example 55

A heat-sensitive recording paper was prepared in the same manner as in Example 52 except that one part of N,N'-diphenyl-p-phenylenediamine was not used.

The obtained ten kinds of heat-sensitive recording papers were tested in the same manner as in Example 1 for color fogging in the background area and color forming ability over the near infrared region which correspond to the above test 1 and test 2. Further, a polyvinyl chloride film was superposed on the heat-sensitive recording paper after recording in the above test 2, and the record image was checked for optical density after placed at room temperature for 24 hours by a spectrophotometer at a wavelength of 850 nm to obtain density resistant to plasticizer. Table 4 also shows rate of color fading (%) which is calculated by the following equation.

$$\text{rate of color fading (\%)} = \frac{C - D}{C} \times 100$$

C: Initial density

D: Density resistant to plasticizer

In Table 4, DRP and RCF(%) mean respectively density resistant to plasticizer and rate of color fading (%).

TABLE 4

| | optical density in test 1 | initial density in test 2 | resistance to plasticizer DRP | resistance to plasticizer RCF(%) |
|---|---|---|---|---|
| Ex. 46 | 0.02 | 0.90 | 0.75 | 16.7 |
| 47 | 0.02 | 0.92 | 0.81 | 12.0 |
| 48 | 0.03 | 0.91 | 0.85 | 6.6 |
| 49 | 0.02 | 0.91 | 0.81 | 11.0 |
| 50 | 0.03 | 0.91 | 0.79 | 13.2 |
| 51 | 0.02 | 0.90 | 0.86 | 4.4 |
| 52 | 0.02 | 0.86 | 0.79 | 8.1 |
| 53 | 0.02 | 0.87 | 0.85 | 2.3 |
| 54 | 0.03 | 0.91 | 0.32 | 64.8 |
| 55 | 0.02 | 0.87 | 0.27 | 69.0 |

As apparent from the results in Examples, the present heat-sensitive recording material using the chromeno compound can be applied to optical character-reading device having a reading wavelength range over the infrared region. The obtained record images do not fade when contacted with humidity or heat, or exposed to light, and have extremely excellent properties.

Further, heat-sensitive recording papers containing a specific amino compound were excellent also in resistance to plasticizer.

We claim:

1. In a heat-sensitive recording material comprising on a substrate a recording layer containing a colorless or pale-colored basic dye and an electron accepting reactant material, the heat-sensitive recording material which is characterized in that the basic dye comprises at least one chromeno compound represented by the formula [I] below

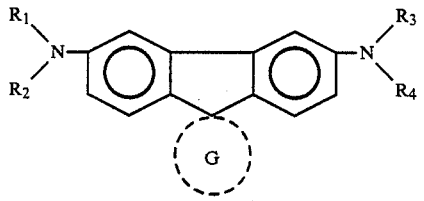

(I)

wherein G represents the following:

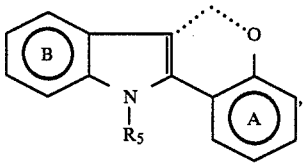

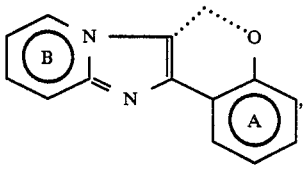

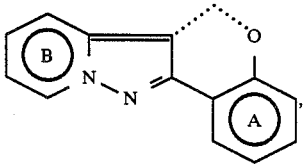

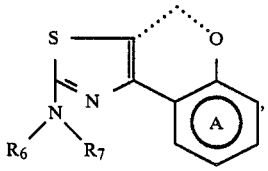

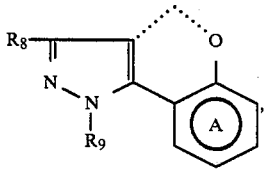

-continued

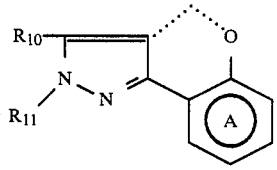

$R_1$, $R_2$, $R_3$ and $R_4$ are each hydrogen atom; $C_{1\sim12}$ alkyl unsubstituted or substituted with halogen atom or $C_{1\sim4}$ alkoxyl; $C_{3\sim12}$ alkenyl unsubstituted or substituted with phenyl; $C_{3\sim12}$ alkynyl unsubstituted or substituted with phenyl; $C_{5\sim12}$ cycloalkyl unsubstituted or substituted with $C_{1\sim4}$ alkyl; phenyl-$C_{1\sim2}$ alkyl unsubstituted or substituted with halogen atom, nitro, $C_{1\sim4}$ alkyl or $C_{1\sim4}$ alkoxyl; phenyl unsubstituted or substituted with halogen atom, nitro, $C_{1\sim4}$ alkyl, $C_{1\sim4}$ alkoxyl or $C_{1\sim4}$ halogenated alkyl; naphthyl unsubstituted or substituted with halogen atom; nitro, $C_{1\sim4}$ alkyl, $C_{1\sim4}$ alkoxyl or $C_{1\sim4}$ halogenated alkyl; $R_1$ and $R_2$, and $R_3$ and $R_4$ may form together therewith or with an adjacent benzene ring a heteroring selected from the group consisting of pyrrolidine ring, piperidine ring, morpholine ring, hexamethyleneimine ring, tetrahydroquinoline ring and julolidine ring; $R_5$, $R_6$, $R_7$, $R_8$, $R_9$, $R_{10}$ and $R_{11}$ are each hydrogen atom; $C_{1\sim12}$ alkyl unsubstituted or substituted with halogen atom or $C_{1\sim4}$ alkoxyl; $C_{3\sim12}$ alkenyl unsubstituted or substituted with phenyl; $C_{3\sim12}$ alkynyl unsubstituted or substituted with phenyl; benzyl unsubstituted or substituted with halogen atom, nitro, $C_{1\sim4}$ alkyl or $C_{1\sim4}$ alkoxyl; phenyl unsubstituted or substituted with halogen atom, nitro, $C_{1\sim4}$ alkyl, $C_{1\sim4}$ alkoxyl or $C_{1\sim4}$ halogenated alkyl; naphthyl unsubstituted or substituted with halogen atom, nitro, $C_{1\sim4}$ alkyl, $C_{1\sim4}$ alkoxyl or $C_{1\sim4}$ halogenated alkyl; $R_6$ and $R_7$ may form a pyrrolidine ring together therewith, each of the benzene ring A and benzene ring B may be substituted by halogen atom; $C_{1\sim4}$ alkyl; $C_{1\sim4}$ alkoxyl; benzyl unsubstituted or substituted with halogen atom, nitro, $C_{1\sim4}$ alkyl or $C_{1\sim4}$ alkoxyl; phenyl unsubstituted or substituted with halogen atom, nitro, $C_{1\sim4}$ alkyl or $C_{1\sim4}$ alkoxyl; amino unsubstituted or substituted with $C_{1\sim4}$ alkyl.

2. A heat-sensitive recording material as defined in claim 1 wherein the chromeno compound is represented by the formula [I'] below

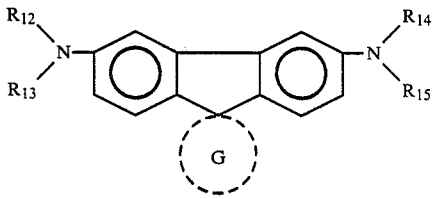

[I']

wherein G represents the following:

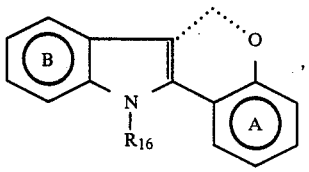

-continued

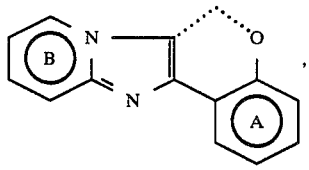

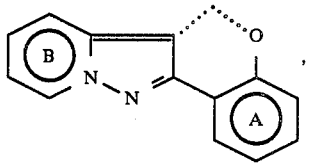

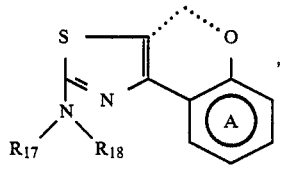

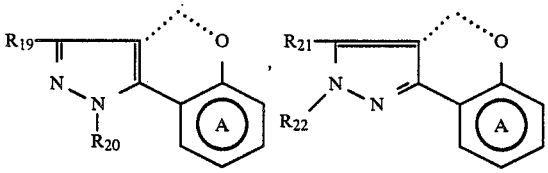

$R_{12}$, $R_{13}$, $R_{14}$ and $R_{15}$ are each hydrogen atom; $C_{1\sim5}$ alkyl unsubstituted or substituted with $C_{1\sim2}$ alkoxy; allyl; $C_{5\sim6}$ cycloalkyl; phenyl-$C_{1\sim2}$ alkyl unsubstituted or substituted with halogen atom, $C_{1\sim2}$ alkyl or $C_{1\sim2}$ alkoxyl; phenyl unsubstituted or substituted with halogen atom, $C_{1\sim2}$ alkyl or $C_{1\sim2}$ alkoxyl; $R_{12}$ and $R_{13}$, and $R_{14}$ and $R_{15}$ may form together therewith a heteroring selected from the group consisting of pyrrolidine ring, piperidine ring, morpholine ring and hexamethyleneimine ring; $R_{16}$, $R_{17}$, $R_{18}$, $R_{19}$, $R_{20}$, $R_{21}$ and $R_{22}$ are each hydrogen atom; $C_{1\sim4}$ alkyl; benzyl; phenyl unsubstituted or substituted with $C_{1\sim2}$ alkyl or $C_{1\sim2}$ alkoxyl; $R_{17}$ and $R_{18}$ may form a pyrrolidine ring together therewith, each of the benzene ring A and benzene ring B may be substituted by halogen atom; $C_{1\sim4}$ alkyl; $C_{1\sim4}$ alkoxyl; benzyl; phenyl; amino unsubstituted or substituted with $C_{1\sim4}$ alkyl.

3. A heat-sensitive recording material as defined in claim 1 which further contains in the recording layer at least one amino compound of the formula [XIII] or [XIV] below

[XIII]

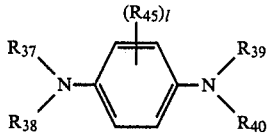

[XIV]

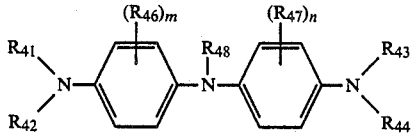

wherein $R_{37}\sim R_{44}$ are each hydrogen atom; $C_{1\sim12}$ alkyl; $C_{5\sim12}$ cycloalkyl; $C_{1\sim4}$ alkoxy-$C_{1\sim4}$ alkyl; $C_{3\sim12}$ alkenyl; $C_{3\sim12}$ alkynyl; benzyl unsubstituted or substituted with halogen atom, nitro, $C_{1\sim4}$ alkyl or $C_{1\sim4}$ alkoxyl; phenyl unsubstituted or substituted with halogen atom, nitro, $C_{1\sim4}$ alkyl, $C_{1\sim4}$ alkoxyl, $C_{1\sim4}$ halogenated alkyl or $C_{6\sim10}$ phenoxy; naphthyl unsubstituted or substituted with halogen atom, nitro, $C_{1\sim4}$ alkyl, $C_{1\sim4}$ alkoxyl, $C_{1\sim4}$ halogenated alkyl or $C_{6\sim10}$ phenoxy; $C_{1\sim12}$ alkylcarbonyl; benzoyl unsubstituted or substituted with halogen atom, $C_{1\sim4}$ alkyl or $C_{1\sim4}$ alkoxyl; benzenesulfonyl unsubstituted or substituted with halogen atom, $C_{1\sim4}$ alkyl or $C_{1\sim4}$ alkoxyl; $R_{37}$ and $R_{38}$, $R_{39}$ and $R_{40}$, $R_{41}$ and $R_{42}$, and $R_{43}$ and $R_{44}$ may form together therewith or with an adjacent benzene ring a heteroring selected from the group consisting of pyrrolidine ring, piperidine ring, morpholine ring, hexamethyleneimine ring and tetrahydroquinoline ring; $R_{45}\sim R_{47}$ are each halogen atom; $C_{1\sim4}$ alkyl; $C_{1\sim4}$ alkoxyl, $R_{48}$ is hydrogen atom; $C_{1\sim4}$ alkyl; phenyl unsubstituted or substituted with halogen atom, $C_{1\sim4}$ alkyl, $C_{1\sim4}$ alkoxyl or di($C_{1\sim4}$ alkyl)amino; naphthyl unsubstituted or substituted with halogen atom, $C_{1\sim4}$ alkyl, $C_{1\sim4}$ alkoxyl or di($C_{1\sim4}$ alkyl)amino, l, m and n are each an integer of $0\sim2$.

4. A heat-sensitive recording material as defined in claim 3 wherein the amino compound is represented by the formula [XIII'] or [XIV'] below

[XIII']

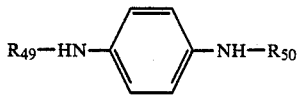

[XIV']

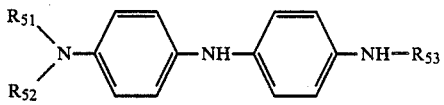

wherein $R_{49}$, $R_{50}$ and $R_{53}$ are each phenyl unsubstituted or substituted with halogen atom, $C_{1\sim4}$ alkyl, $C_{1\sim4}$ alkoxyl or $C_{6\sim10}$ phenoxy; naphthyl unsubstituted or substituted with halogen atom, $C_{1\sim4}$ alkyl, $C_{1\sim4}$ alkoxyl or $C_{6\sim10}$ phenoxy; $R_{51}$ and $R_{52}$ are each hydrogen atom; $C_{1\sim4}$ alkyl; phenyl unsubstituted or substituted with halogen atom, $C_{1\sim4}$ alkyl, $C_{1\sim4}$ alkoxyl or $C_{6\sim10}$ phenoxy; naphthyl unsubstituted or substituted with halogen atom, $C_{1\sim4}$ alkyl, $C_{1\sim4}$ alkoxyl or $C_{6\sim10}$ phenoxy.

5. A heat-sensitive recording material as defined in claim 4 wherein the amino compound is represented by the formula [XIII''] or [XIV''] below

[XIII'']

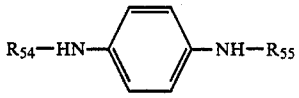

[XIV'']

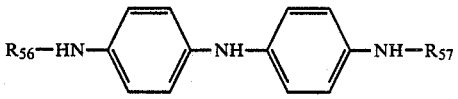

wherein $R_{54}\sim R_{57}$ are each phenyl unsubstituted or substituted with methyl; naphthyl unsubstituted or substituted with methyl.

6. A heat-sensitive recording material as defined in claim 5 wherein the amino compound is N,N'-di-$\beta$-naphthyl-p-phenylenediamine.

7. A heat-sensitive recording material as defined in claim 1 wherein the electron accepting reactant material is a polyvalent metal salt of an aromatic carboxylic acid.

8. A heat-sensitive recording material as defined in claim 7 wherein the aromatic carboxylic acid is represented by the formula [XI] below

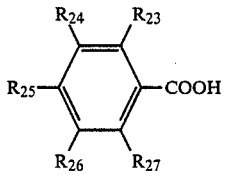

[XI]

wherein $R_{23}\sim R_{27}$ are each hydrogen atom; halogen atom; $C_{1\sim12}$ alkyl unsubstituted or substituted with halogen atom; $C_{5\sim12}$ cycloalkyl; $C_{1\sim12}$ alkoxyl; phenyl unsubstituted or substituted with halogen atom, nitro, $C_{1\sim4}$ alkyl or $C_{1\sim4}$ alkoxyl; naphthyl unsubstituted or substituted with halogen atom, nitro, $C_{1\sim4}$ alkyl or $C_{1\sim4}$ alkoxyl; phenoxy unsubstituted or substituted with halogen atom, nitro, $C_{1\sim4}$ alkyl or $C_{1\sim4}$ alkoxyl; benzyl unsubstituted or substituted with halogen atom, nitro, $C_{1\sim4}$ alkyl or $C_{1\sim4}$ alkoxyl; benzyloxy unsubstituted or substituted with halogen atom, nitro, $C_{1\sim4}$ alkyl or $C_{1\sim4}$ alkoxyl; nitro; cyano; $C_{1\sim4}$ alkylcarbonyl; benzoyl unsubstituted or substituted with halogen atom, $C_{1\sim4}$ alkyl or $C_{1\sim4}$ alkoxyl; hydroxyl; $COOR_{28}$; $CON(R_{29})(R_{30})$; $R_{28}\sim R_{30}$ are each hydrogen atom; $C_{1\sim12}$ alkyl unsubstituted or substituted with halogen atom, $C_{1\sim4}$ alkoxyl or hydroxyl; $C_{5\sim12}$ cycloalkyl unsubstituted or substituted with $C_{1\sim4}$ alkyl; benzyl unsubstituted or substituted with halogen atom, nitro, $C_{1\sim4}$ alkyl or $C_{1\sim4}$ alkoxyl; phenyl unsubstituted or substituted with halogen atom, nitro, $C_{1\sim4}$ alkyl or $C_{1\sim4}$ alkoxyl; naphthyl unsubstituted or substituted with halogen atom, nitro, $C_{1\sim4}$ alkyl or $C_{1\sim4}$ alkoxyl; $R_{29}$ and $R_{30}$ may form together therewith a heteroring selected from the group consisting of pyrrolidine ring, piperidine ring, morpholine ring and hexamethyleneimine ring; $R_{25}$ and $R_{26}$, or $R_{26}$ and $R_{27}$ may form a naphthalene ring together therewith.

9. A heat-sensitive recording material as defined in claim 7 wherein the aromatic carboxylic acid is represented by the formula [XII] below

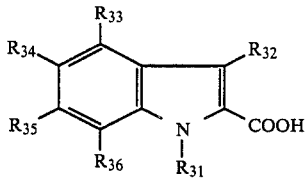

[XII]

wherein $R_{31}$ is hydrogen atom; $C_{1\sim12}$ alkyl unsubstituted or substituted with halogen atom; $C_{5\sim12}$ cycloalkyl; $C_{3\sim12}$ alkenyl unsubstituted or substituted with phenyl; $C_{3\sim12}$ alkynyl unsubstituted or substituted with phenyl; phenyl unsubstituted or substituted with halogen atom, nitro, $C_{1\sim4}$ alkyl, $C_{1\sim4}$ alkoxyl or $C_{1\sim4}$ halogenated alkyl; naphthyl unsubstituted or substituted with halogen atom, nitro, $C_{1\sim4}$ alkyl, $C_{1\sim4}$ alkoxyl or $C_{1\sim4}$ halogenated alkyl; benzyl unsubstituted or substituted with halogen atom, nitro, $C_{1\sim4}$ alkyl or $C_{1\sim4}$ alkoxyl; $C_{1\sim4}$ alkylcarbonyl; benzoyl unsubstituted or substituted with halogen atom, $C_{1\sim4}$ alkyl or $C_{1\sim4}$ alkoxyl; $R_{32}\sim R_{36}$ are each hydrogen atom; $C_{1\sim4}$ alkyl unsubstituted or substituted with halogen atom or $C_{1\sim4}$ alkoxyl; $C_{5\sim6}$ cycloalkyl; phenyl unsubstituted or substituted with halogen atom, nitro, $C_{1\sim4}$ alkyl, $C_{1\sim4}$ alkoxyl or hydroxyl; benzyl unsubstituted or substituted with halogen atom, nitro, $C_{1\sim4}$ alkyl or $C_{1\sim4}$ alkoxyl; $C_{1\sim4}$ alkoxyl; $C_{5\sim6}$ cycloalkyloxy; $C_{3\sim4}$ alkenyloxy unsubstituted or substituted with phenyl; $C_{3\sim4}$ alkynyloxy unsubstituted or substituted with phenyl; phenoxy unsubstituted or substituted with halogen atom, $C_{1\sim4}$ alkyl or $C_{1\sim4}$ alkoxyl; benzyloxy unsubstituted or substituted with halogen atom, $C_{1\sim4}$ alkyl or $C_{1\sim4}$ alkoxyl; $C_{1\sim4}$ alkylcarbonyloxy; benzoyloxy unsubstituted or substituted with halogen atom, $C_{1\sim4}$ alkyl or $C_{1\sim4}$ alkoxyl; $C_{1\sim4}$ alkylcarbonyl; benzoyl unsubstituted or substituted with halogen atom, $C_{1\sim4}$ alkyl or $C_{1\sim4}$ alkoxyl; di($C_{1\sim4}$ alkyl)amino; halogen atom; nitro; cyano; hydroxyl.

10. A heat-sensitive recording material as defined in claim 7 wherein the polyvalent metal is magnesium, calcium, barium, zinc, aluminum, tin, iron, cobalt, nickel or copper.

* * * * *